US008136542B2

(12) United States Patent
Warren

(10) Patent No.: US 8,136,542 B2
(45) Date of Patent: Mar. 20, 2012

(54) HIKING STICK

(76) Inventor: Bruce Arthur Warren, Lake Jackson, TX (US)

( * ) Notice: Subject to any disclaimer, the term of this patent is extended or adjusted under 35 U.S.C. 154(b) by 54 days.

(21) Appl. No.: 12/354,286

(22) Filed: Jan. 15, 2009

(65) Prior Publication Data

US 2010/0175728 A1 Jul. 15, 2010

(51) Int. Cl.
*A45B 1/00* (2006.01)
*A45B 9/02* (2006.01)
*A45B 3/00* (2006.01)

(52) U.S. Cl. ..... 135/65; 135/66; 135/76; 403/409.1

(58) Field of Classification Search ..... 135/65, 135/76; 280/819, 820, 823; 403/109.5, 409.1
See application file for complete search history.

(56) References Cited

U.S. PATENT DOCUMENTS 1,765,076 A * 6/1930 Jung ..... 135/65
2,392,083 A * 1/1946 Dumbleton ..... 135/65
4,679,960 A * 7/1987 Mizuhara ..... 403/272
5,482,071 A * 1/1996 Liu ..... 135/66
2003/0047203 A1* 3/2003 Lah ..... 135/114
2006/0011227 A1* 1/2006 McBirney ..... 135/65
2006/0254633 A1* 11/2006 Willis ..... 135/74
2007/0177937 A1* 8/2007 Holowczak et al. ..... 403/300
2007/0261859 A1* 11/2007 Telfer ..... 166/381
2009/0072531 A1* 3/2009 Kertesz et al. ..... 285/148.6

* cited by examiner

*Primary Examiner* — David Dunn
*Assistant Examiner* — Danielle Jackson
(74) *Attorney, Agent, or Firm* — Michael D. Eisenberg

(57) ABSTRACT

A hiking stick including a first section, which includes: a first shaft and a male joining piece attached to the shaft, and extending away from the shaft. The male joining piece has an uncut portion and a beveled portion. The bevel is formed by a plane cut at the end of the joining piece at an angle with a long the axis of the hiking stick. A second section includes a second shaft having a hollow end configured for receiving the male joining piece, such that an inner wall of the end of the second shaft has a radial cross section which is narrower than a radial cross section of the widest portion of the male joining piece. The male joining piece is configured for being inserted into the end of the second section, and for being radially compressed by the end of the second section.

12 Claims, 7 Drawing Sheets

HIKING STICK

TECHNICAL FIELD

The present invention, in some embodiments thereof, relates to shafts, tubes, and sticks, and more specifically to hiking sticks.

BACKGROUND OF THE INVENTION

A hiking stick is an item widely used by hikers, to facilitate a hiker's walk through rough terrain, by supporting part of the hiker's weight. At times, however, the hiking stick may be a burden to the hiker. A long hiking stick may be helpful in rough terrain, but may be cumbersome to carry in easier paths, when the hiking stick is not needed. In addition, a long hiking stick may occupy a lot of space when the stick is stored, for example, in a storage compartment or in the hiker's backpack. Furthermore, a heavy hiking stick may be difficult to carry and use, therefore limiting the usefulness of the stick to the hiker.

BRIEF SUMMARY OF EMBODIMENTS OF THE INVENTION

The present invention relates to a hiking stick having at least two separate sections, such that the hiking stick is repeatably assemblable and disassemblable by a user.

An aspect of some embodiments of the present invention relates to a hiking stick, which includes:

a first section, including a first shaft, and a male joining piece attached to the shaft, and extending away from the shaft, the male joining piece having an uncut portion and a beveled portion, the bevel being formed by a plane cut at the end of the joining piece at an angle with a long the axis of the hiking stick;

and a second section, including a second shaft having a hollow end configured for receiving the male joining piece, such that an inner wall of the end of the second shaft has a radial cross section which is narrower than a radial cross section of the widest portion of the male joining piece.

The male joining piece is designed for being inserted into the end of the second section, and for being radially compressed by the end of the second section, thereby providing friction between the second section and the male joining piece, and keeping the first and second sections together. The first section is repeatably insertable into and repeatably removable from the second section.

In a variant, the angle formed by the cutting plane and the long axis of the hiking stick is within a range between about 7 degrees and about 9 degrees.

In another variant, the angle measures about 8 degrees.

In a further variant, the end of the joining piece is truncated, the truncation being formed by a cut of the beveled potion of the joining piece along a plane perpendicular to the long axis of the hiking stick. A radial cross section of the narrowest portion of the joining piece is smaller than the radial cross section of the hollow end of the second section.

In yet a further variant, at least one of the shaft of the first section, the second section, and the male joining piece is at least partially hollow.

According to some embodiments of the present invention, the shaft of first section includes a first outer pipe; and a first sleeve, lining at least part of an inner surface of the outer pipe, and surrounding an insert of the male joining piece attached to the inner surface of the shaft of the first section. The shaft of the second section includes a second outer pipe; and a second sleeve, lining at least part of an inner surface of the second outer pipe. The first sleeve is recessed within the first outer pipe, thereby leaving an empty space between the first sleeve and the second sleeve when the first section and second section are connected, the empty space being configured for receiving a foreign material which would otherwise deny contact between an edge of the first outer pipe and an edge of the second outer pipe.

Optionally, the first sleeve has a distal end, closest to the beveled potion of the joining piece, and a proximal end, farthest from the beveled potion of the joining piece; the male joining piece has a proximal end, located within the first section and farthest from the beveled potion of the joining piece; and the proximal end of the first sleeve is disposed farther from the beveled potion of the joining piece than the proximal end of the joining piece, in order to reduce point loading on the outer pipe when the hiking stick is under a large bending load.

In a variant the sleeves are made of aluminum and the outer pipes are made of carbon fiber laminate.

In another variant, the above hiking stick further includes polyurethane glue for attaching at least one of the following pairs: the first sleeve to the first outer pipe; the first sleeve to the male joining piece; and the second sleeve to the second outer pipe.

In a further variant the second sleeve is made of anodized aluminum, and the male joining piece is made of unanodized aluminum.

According to some embodiments of the present invention, the above hiking stick, further includes a sliding handstrap wound around the hiking stick, and designed for being strapped around a wrist of a user. The handstrap is configured for being loosened, slid along the hiking stick, and tightened at a position chosen by a user.

Optionally, the above hiking stick is designed for being held by a user, such that the male joining piece is on a lower end of the first section, and the first section is above the second section; the handstrap is wound about the first section; a top edge of the first section is flared for preventing the handstrap from sliding off the top end the first section; and a top edge of the second section is wider than the rest of the second section, for preventing the handstrap from falling off the bottom of the first section.

In a variant, the male joining piece comprises a knife edge. The knife edge is sheathed when the joining piece is inserted into the second section.

According to some embodiments of the present invention, a hiking stick is provided, including:

a plurality of sections, each section according to the first section mentioned above, each section being connected to another via a male joining piece, according to the male joining piece mentioned above; and an end section, according to any embodiment described above, located at an end of the hiking stick.

The end section is connected to one of the plurality of sections through the male joining piece of the one of the plurality of sections.

An aspect of some embodiments of the present invention relates to a tube member, which includes:

a hollow conduit; and a hollow male joining piece attached to the conduit and extending away from the conduit, the male joining piece having an uncut portion and a beveled portion, the bevel being formed by a plane cut at the end of the joining piece at an angle with a long the axis of the tube member.

The male joining piece is designed for being inserted into an end of a tubing section having an inner wall with a radial cross section which is narrower than a radial cross section of the widest portion of the joining piece, and for being radially compressed by the end of the tubing section, thereby providing friction between the tubing section and male joining piece, and keeping the tube member attached to the tubing section. The male joining piece is configured for allowing passage of a material from the tube member to the tubing section.

In a variant, the angle formed by the cutting plane and the long axis of the tube member is within a range between about 7 degrees and about 9 degrees.

In another variant, the male joining piece is truncated, the truncation being formed by a cut of the beveled potion of the joining piece along a plane perpendicular to the long axis of the tube member; and a radial cross section of the narrowest portion of the joining piece is smaller than the radial cross section of the hollow end of the second section.

According to some embodiments of the present invention, a duct is provided, which includes:

a first tube member according to the above tube member, wherein the conduit includes: a first outer pipe, and a first sleeve, lining at least part of an inner surface of the outer pipe, and surrounding an insert of the male joining piece attached to the inner surface of the conduit; and a second tube member, including a second outer pipe, and a second sleeve lining at least part of an inner surface of the second outer pipe;

The first tube member is connected to the second tube member by means of the male joining piece, such that the first outer pipe is in contact with the second outer pipe. The first sleeve is recessed within the first outer pipe, thereby leaving an empty space between the first sleeve and the second sleeve, the empty space being configured for receiving a foreign material which would otherwise deny contact between an edge of the first outer pipe and an edge of the second outer pipe.

In a variant, polyurethane glue is used to attach at least one of the following pairs: the first sleeve to the first outer pipe; the first sleeve to the male joining piece; and the second sleeve to the second outer pipe.

According to some embodiments of the present invention, a piping structure is provided, the structure including a plurality of tube members according to the tube member mentioned above, each tube member being connected to another through a male joining piece, according to the male joining piece mentioned above.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

DETAILED DESCRIPTION OF THE EMBODIMENTS OF THE INVENTION

Figure 1:
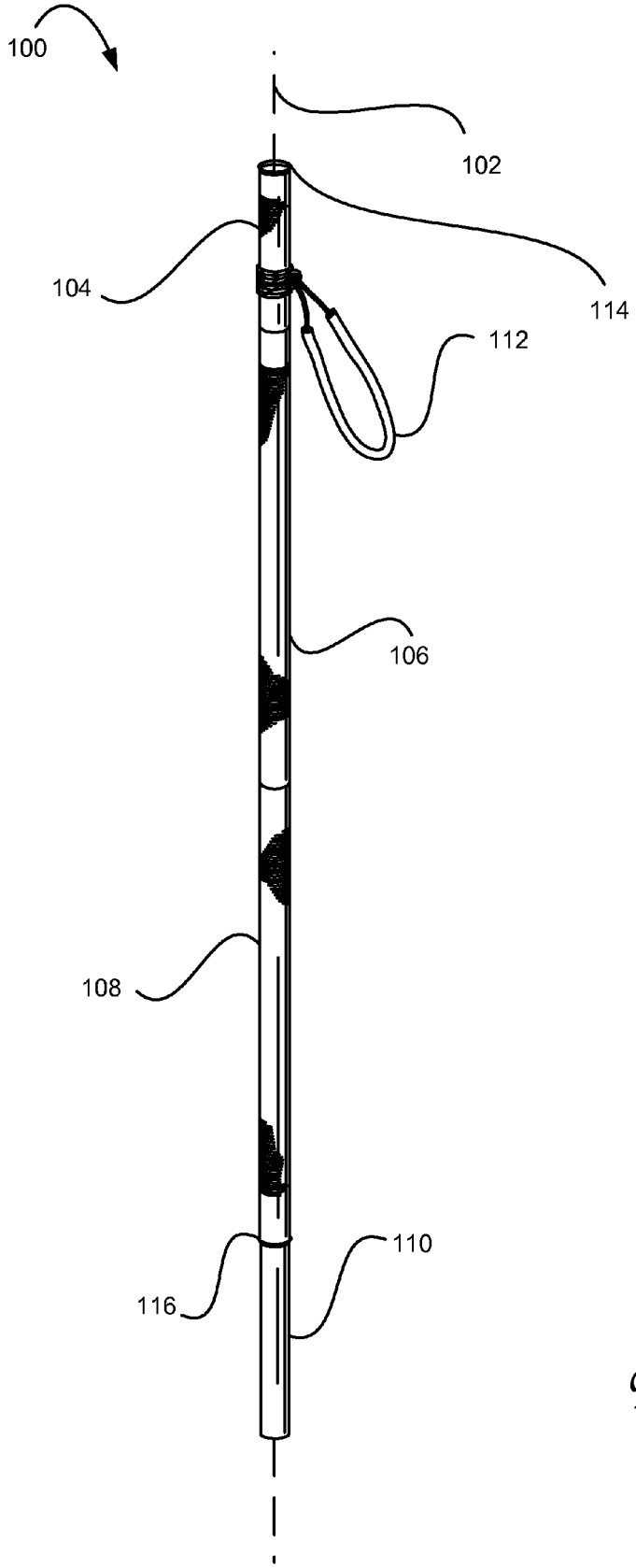
FIG. 1 is a drawing illustrating an assembled hiking stick, according to some embodiments of the present invention.

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Before describing embodiments of the present invention, some terms are to be defined. Herein, the terms "long axis" and "central axis" are interchangeable, and refer to the axis around which a straight tubular object, such as a straight stick, straight pipe, straight shaft, straight tube, or straight tube member, is centered.

A surface facing the long axis is herein referred to as "inner surface. A surface facing away from the long axis is herein referred to as "outer surface".

A cross section of an object on a plane perpendicular to the long axis is herein referred to as "radial cross section". Similarly, a force acting on an object, and having a direction along the radial cross section of the object is herein referred to as "radial force". A cross section of an object on a plane parallel to the long axis is herein referred to as "vertical cross section". Similarly a force acting on an object, and having a direction parallel to the long axis is herein referred to as "vertical force".

When relating to a protrusion or an extension of an object, the term "distal" herein refers to the part of the protrusion or extension, which is farthest from the main body object. The term "proximal" herein refers to a part of the protrusion or extension, which is closest to the main body of the object. Similarly, when relating to an object, the term "distal" herein refers to a part of the object closest to the distal extremity of the protrusion or extension. The term "proximal" herein refers to a part of the object farthest away from the distal end of the protrusion or extension.

A bevel is a plane cut of an object, the cut being at an angle with the long axis of the object. The angle between the plane of the cut and the long axis of the object is herein referred to as the "bevel angle".

The present invention, described herein with reference to some embodiments thereof, relates to shafts, tubes, and sticks, and more specifically to hiking sticks.

An aspect of some embodiments of the present invention relates to a hiking stick composed of at least two sections, which may be separated from each other. The first section includes a male joining piece extending out of the first section, and designed for being inserted into a hollow end of the second section. The male joining piece includes a beveled potion, such that the joining piece is narrowest at a distal extremity thereof, and widest at a proximal end thereof. As the joining piece is inserted into the hollow end of the second section, the narrowest part of the beveled potion of the joining piece is the first part of the joining piece, which enters the hollow end. The radial cross section of the inner wall of hollow end of the second section is narrower than the radial cross section of the widest part of the joining piece. The hollow end, therefore radially compresses the joining piece, so that a friction between the joining piece and the inner wall of the second section is created. The above friction keeps the first and second section together. The first section may be inserted into the second section and may be removed from the second section, repeatedly a plurality of times. Therefore the hiking stick may be repeatably assembled and disassembled.

The number of sections composing the hiking stick and the length of each individual section can be chosen in order to facilitate the storage of the disassembled stick.

In a variant, the beveled potion of the joining piece is truncated. The truncation is formed by a cut of the beveled potion along a plane perpendicular to the long axis of the hiking stick. A truncated joining piece is shorter, and therefore lighter, than a beveled joining piece characterized by the same bevel angle, while providing enough friction for keeping two sections together. Thus, a section having a truncated joining piece is lighter than a section having a full length beveled joining piece with the same bevel angle, making the hiking stick lighter. It is also less dangerous as the a non-truncated joining piece could easily impale a person.

According to some embodiments of the present invention, the distal end of at least one section of the hiking stick is a knife edge, optionally similar to an end of a hypodermic needle. This distal end may be used by a hiker for defending himself or herself, or for cutting. In another aspect, the distal end is sharply pointed and can be used to impale an attacker for defense.

Another aspect of some embodiments of the present invention relates to a tube member, including a hollow conduit and a hollow beveled male joining unit. The above tube member may be joined to a second hollow tube member, by inserting the joining unit into a narrow end of second tube member. The male joining unit is hollow, for allowing the passage of a material, for example a liquid or a gas, from the first tube member to the second tube member.

According to some embodiments of the present invention, the above tube member may be used with similar tube members in a piping structure, for example a water carrying structure.

Figure 7:
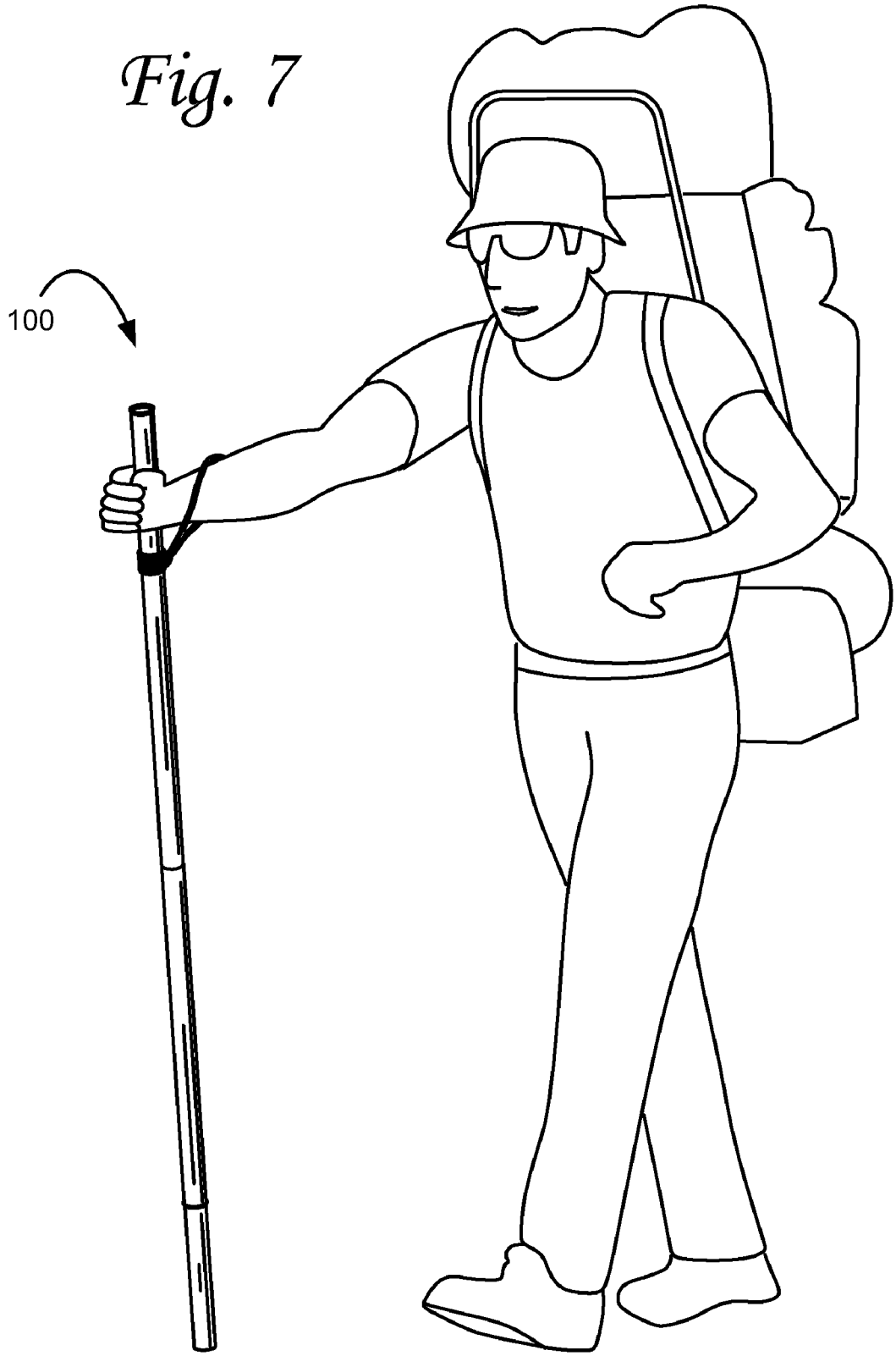
FIG. 7 is a perspective view of a user operating the hiking stick. de The figures are not intended to be exhaustive or to limit the invention to the precise form disclosed. It should be understood that the invention can be practiced with modification and alteration, and that the invention be limited only by the claims and the equivalents thereof.

Referring now to the figures, FIGS. 1 and 7 are drawings illustrating an assembled hiking stick 100, according to some embodiments of the present invention.

The hiking stick 100 is centered around a long axis 102. The hiking stick 100 includes four sections: a top section 104 is connected to a higher intermediate section 106; the higher intermediate section 106 is connected to a lower intermediate section 108; the lower intermediate section is connected to a bottom section 110. The sections are connected to each other via male joining pieces described in FIG. 2. The sections may be repeatably connected to each other and disconnected from each other, making the hiking stick 100 assemblable and disassemblable. An assemblable and disassemblabe hiking stick may be easier to store and less cumbersome to carry when not in use than a hiking stick which may not be disassembled.

Figure 2:
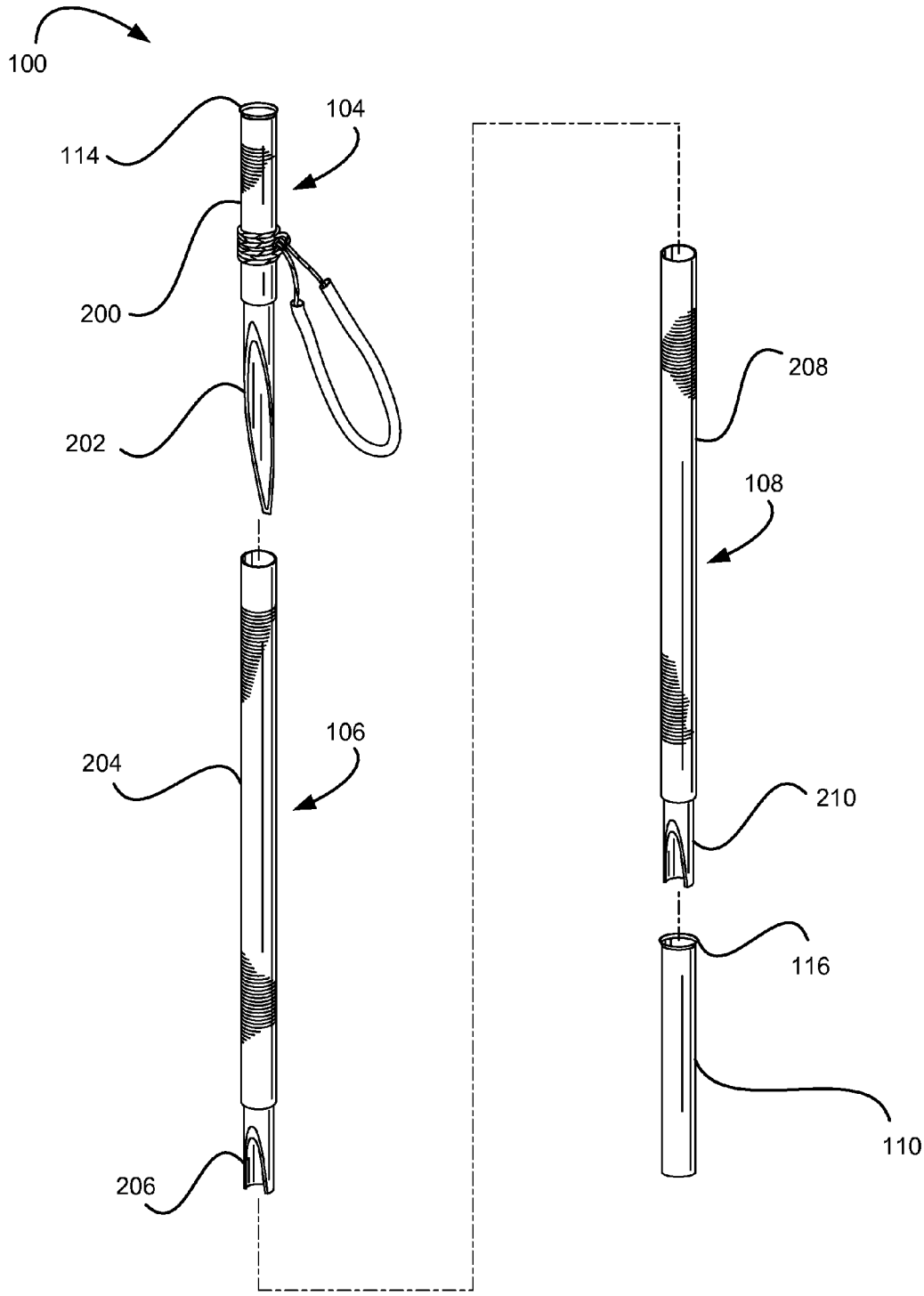
FIG. 2 is a perspective drawing illustrating separated sections of a hiking stick, according to some embodiments of the present invention.

Optionally, referring to FIGS. 1, 2 and 7, the hiking stick 100 further includes a sliding hand strap 112, designed for being strapped around a wrist or hand of a user, thereby decreasing the chances of the user dropping the hiking stick 100. The hand strap 112 is wound around the hiking stick 100 in the configuration of the Prussik knot commonly used by climbers for ascending a rope. Other methods of wounding the hand strap 112 around the hiking stick 100 may be applied, as well. A user may choose the position of the hand strap 112, by loosening the prussik knot of the hand strap 112, sliding the handstrap 112 along the hiking stick, and tightening the prussik knot by using downward pressure to lock the hand strap around the hiking stick 100 at a preferred position.

A user may prefer to hold the walking stick 100 at different points, during different potions of the user's track. For example, as the user is walking downhill, the user may find it advantageous to hold the hiking stick 100 from a higher point. Similarly, the user may find it advantageous to hold the hiking stick 100 from a lower point, while the user is walking uphill. The features of the hand strap 112 described above allow a user to adjust the position of the hand strap 112 along the hiking stick 100 very quickly. Optionally, the user may slide the strap to the preferred position on the go, without the need for stopping.

Furthermore, the hand strap 112 may be positioned anywhere along the hiking stick 100, even near the bottom section of the hiking stick 100. In such a configuration, the hiking stick 100 may be useful for clawing up a steep ascent.

The portion of the hand strap 112, which is wound around the hiking stick 100 may be made of woven or braided cord, or solid plastic cord. The portion of the hand strap 112, which comes into contact with the user's wrist or hand may be made of thin wall plastic tubing.

According to some variants, the top section 104 of the hiking stick 100 has a flared top edge 114, to prevent the hand strap 112 from sliding off the top of the hiking stick 100, when the hand strap 112 is wound in the preferred position around the hiking stick 100. The bottom section 110 also sports a flared top edge 116, to prevent the hand strap 112 from falling off the bottom of the hiking stick 100, when the hand strap 112 is wound in the preferred position around the hiking stick 100. In one embodiment, the bottom section 110 has epoxy filled inside the tip 115.

Though the hiking stick 100 has been shown to have four sections, a hiking stick according to some embodiments of the present invention may include any number of sections that is equal or higher than two. The number of sections and the vertical height of each section may be chosen to facilitate the storage of the disassembled hiking stick.

According to an exemplary embodiment of the present invention, a radial cross section of the hiking stick 100 has a circular shape. However, the radial cross section of the hiking stick 100 may be any shape, for example elliptical, rounded corner rectangle or triangle.

FIG. 2 is a perspective drawing illustrating separated sections of a hiking stick 100, according to some embodiments of the present invention.

The hiking stick 100 of FIG. 1 is shown in FIG. 2 in separate sections. The top section 104 includes a shaft 200 and a male joining piece 202 extending away from the shaft 200. The higher intermediate section 106 includes a shaft 204 and a male joining piece 206. The lower intermediate section 108 includes a shaft 208 and a male joining piece 210. Each of the joining pieces 202, 206, and 208 include a bevel. Optionally, at least one of the joining pieces 202, 206, and 208 includes a truncated bevel. The bevel and truncated bevel which will be explained more in depth in the description of FIGS. 3*a*, 3*b*, 4*a*, and 4*b*.

The top section 104 is connected to the higher intermediate section 106, by inserting the joining piece 202 into a hollow end on the top of the higher intermediate section 106. The inner wall of the hollow end of the intermediate section 106 has a radial cross section, which is narrower than a radial cross section of the widest portion of the joining piece 202. As the joining piece 202 is inserted into the higher intermediate section 106, the joining piece 202 is radially compressed by the inner wall of the hollow end of the intermediate section 106. The compression gives rise to a friction between the joining piece 202 and the inner wall of the intermediate section 106. This friction keeps the top section 104 connected to the higher intermediate section 106.

The connection between the higher intermediate section 106 and the lower intermediate section 108, and the connection between the lower intermediate section 108 and the bottom section 110 are established in a manner similar to that of the connection between the top section 104 and the higher intermediate section 106 described above.

According to some embodiments of the present invention, one or more of the shafts of the sections, and/or one or more of the male joining pieces described above are at least partially hollow. In this manner, the weight of the hiking stick 100 is reduced. A light hiking stick is less cumbersome to carry than a heavy hiking, both when in use and when not in use.

According to some embodiments of the present invention, at least one of the joining pieces 202, 206, and 210 includes a knife edge, which is sheathed when the hiking stick 100 is fully assembled. The knife edge is easily accessible to the user using the hiking stick 100, and may be quickly unsheathed for self defense; alternatively the knife edge may be used for cutting. Optionally, the joining piece 202 of the top section 104 includes a knife edge. According to some embodiments of the present invention, the top section 104 is the closest to the user's end, and therefore the unsheathing of the knife edge may be executed quickly. Optionally, the assembled hiking stick may utilize multiple sections with a knife edge.

Figure 3A:
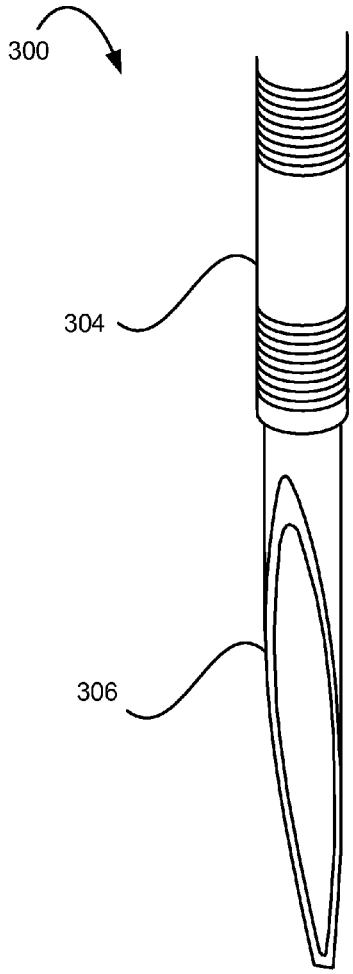
FIGS. 3*a* and 3*b* are drawings illustrating a section of a hiking stick, having a beveled joining piece, according to some embodiments of the present invention.
Figure 3B:
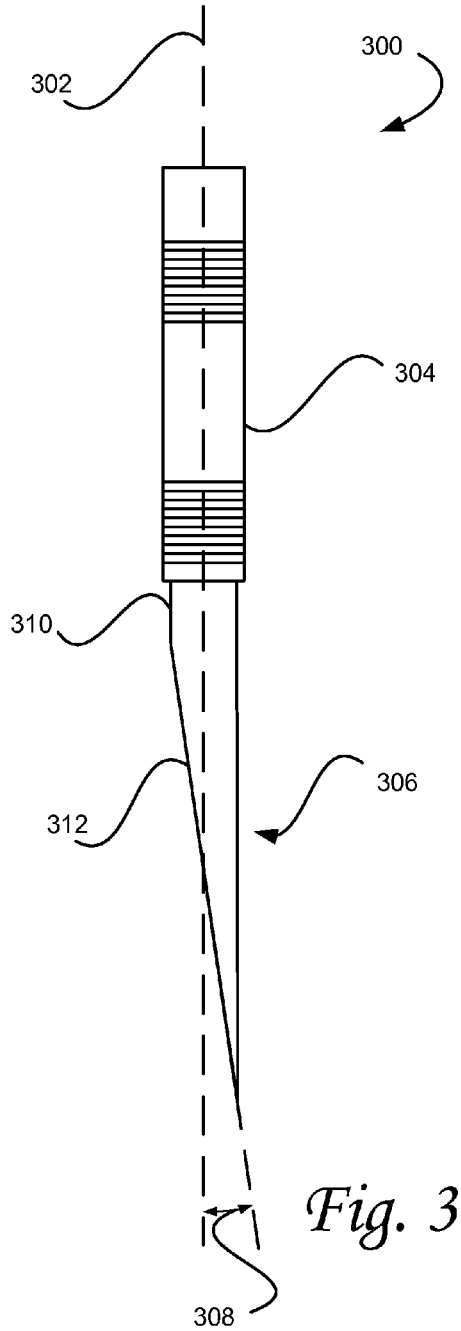

FIGS. 3*a* and 3*b* are drawings illustrating an exemplary section 300 of a hiking stick, having a beveled joining piece, according to some embodiments of the present invention. FIG. 3*a* is a perspective view of the section 300. FIG. 3*b* is a vertical cross section of the section 300.

The section 300 is centered around a long axis 302 and includes a shaft 304 and a male joining piece 306. Optionally, the section 300 may be substituted to any of the sections of FIGS. 1 and 2, and the long axis 302 corresponds to the long axis 102 of the hiking stick 100.

The joining piece 306 is beveled, the bevel being formed by a plane cut of the joining piece 306 at a bevel angle 308 with the long axis 302. The joining piece 306 includes an uncut portion 310, and a cut portion 312. The distal edge of the joining piece 306 is pointed. In the cut portion 312, the size of the radial cross section of the joining piece 306 increases, as a vertical distance between the radial cross section and the distal edge of the joining piece 306 increases, until the radial cross section reaches a maximum at the proximal side of the cut portion 312. The size of the radial cross section along the uncut portion 310 remains constant.

A pointed beveled joining piece 306 may be used as a knife edge for self defense, or for cutting.

As explained above, the joining piece 306 is designed to enter a hollow shaft of a second section, the hollow shaft having a radial cross section narrower than the maximal radial cross section of the joining piece 306. The joining piece 306 is compressed as the joining piece 306 enters the narrower hollow shaft, and the compression creates a friction between the joining piece 306 and the inner wall of the hollow shaft. The friction keeps the section 306 and the second section together.

As the joining piece 306 enters the second section, the initial friction is very small, since contact between the distal edge of the joining piece and the inner wall of the second section is very limited. As the joining piece 306 is inserted more and more deeply into the second section, the friction increases, since the area of contact between the distal edge of the joining piece and the inner wall of the second section increases. When the radial cross section of the joining piece 306 matches the radial cross section of the inner wall of the second section, the radial compression of the joining piece 306 commences, and friction increases greatly. The deeper the joining piece 306 is inserted into the second section, the more the friction increases. When the uncut portion 310 enters the second section, there is full contact between the radial cross section of the outer surface of the joining piece 306 and radial cross section of the inner surface of the hollow shaft of the second section.

The size of the bevel angle 308 is chosen in order to increase friction between the male joining piece 306 and the inner wall of the second section. According to some embodiments of the present invention, a shallow bevel angle 308 (an angle closer to zero) is selected, in order to increase friction, by increasing the compression during the insertion of the joining piece into the second section. In some variants, the bevel angle 308 is less than about 9 degrees.

As the size of the bevel angle 308 decreases, the length of the male joining piece 306 increases. A long joining piece is heavier than shorter joining piece, and causes the vertical length of the section 300 to be longer. According to some embodiments of the present invention, the bevel angle 308 is chosen to measure more than about 7 degrees, in order to limit the length of the joining piece 306.

According to an exemplary embodiment of the present invention, the bevel angle is within a range between about 7 degrees and about 9 degrees. According to another exemplary embodiment of the present invention, the bevel angle is selected to be about 8 degrees, in order to provide sufficient friction, while limiting the length of the joining piece 306.

Optionally, the section 300 is a hollow tube member designed to allow the passage of a material from a distal to a proximal end thereof, and/or from a proximal to a distal end thereof. The material may be, for example, a liquid or a gas. The section 300 is designed for being connected to at least another hollow tube member. According to some embodiments of the present invention, the section 300 is a tube member, which is part of a piping structure, for example, an air flow or a water carrying infrastructure.

Figure 4A:
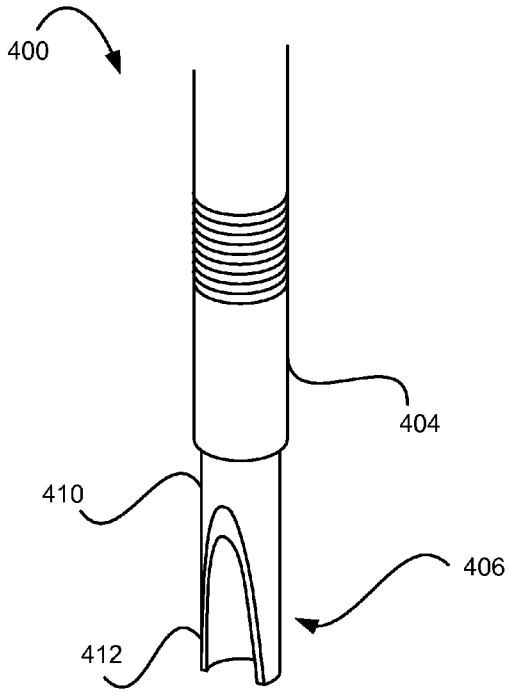
FIGS. 4*a* and 4*b* are drawings illustrating a section of a hiking stick, having a truncated beveled joining piece, according to some embodiments of the present invention.
Figure 4B:
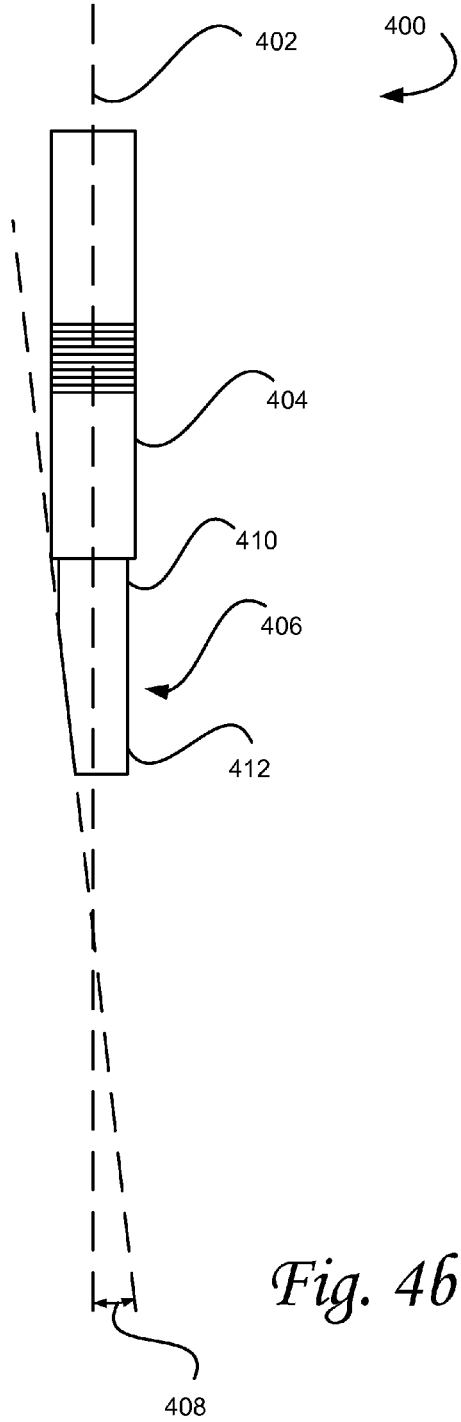

FIGS. 4*a* and 4*b* are drawings illustrating a section 400 of a hiking stick, having a truncated beveled joining piece, according to some embodiments of the present invention. FIG. 4*a* is a perspective view of the section 400. FIG. 4*b* is a vertical cross section of the section 400.

The section 400 is centered around a long axis 402 and includes a shaft 404 and a male joining piece 406. Optionally, the section 400 may be substituted to any of the sections of FIGS. 1 and 2, and the long axis 402 corresponds to the long axis 102 of the hiking stick 100.

The joining piece 406 is beveled, the bevel being formed by a plane cut of the joining piece 406 at a bevel angle 408 with the long axis 402. The joining piece 406 includes an uncut portion 410, and a cut portion 412. The joining piece 406 is truncated. The truncation is formed by a cut of the beveled potion 412 of the joining piece along a plane perpendicular to the long axis 402.

The insertion of the joining piece 406 into a second section is as described above. According to some embodiments of the present invention, the location of the truncation is chosen so that the narrowest radial cross section of the joining piece 406 is narrower than the radial cross section of the second section. In this manner, the insertion of the joining piece 406 into the second section is facilitated.

For the same bevel angle, the truncated joining piece 406 is shorter and lighter, and therefore less cumbersome, than the full length beveled joining piece 306, while providing a similar level of friction.

Furthermore, because the joining piece 406 is not pointed, it may be safer for use than the full length beveled joining piece 306.

Like the section 300 of FIGS. 3*a* and 3*b*, the section 400 may also be used as a tube member, which may be part of a piping structure.

Figure 5:
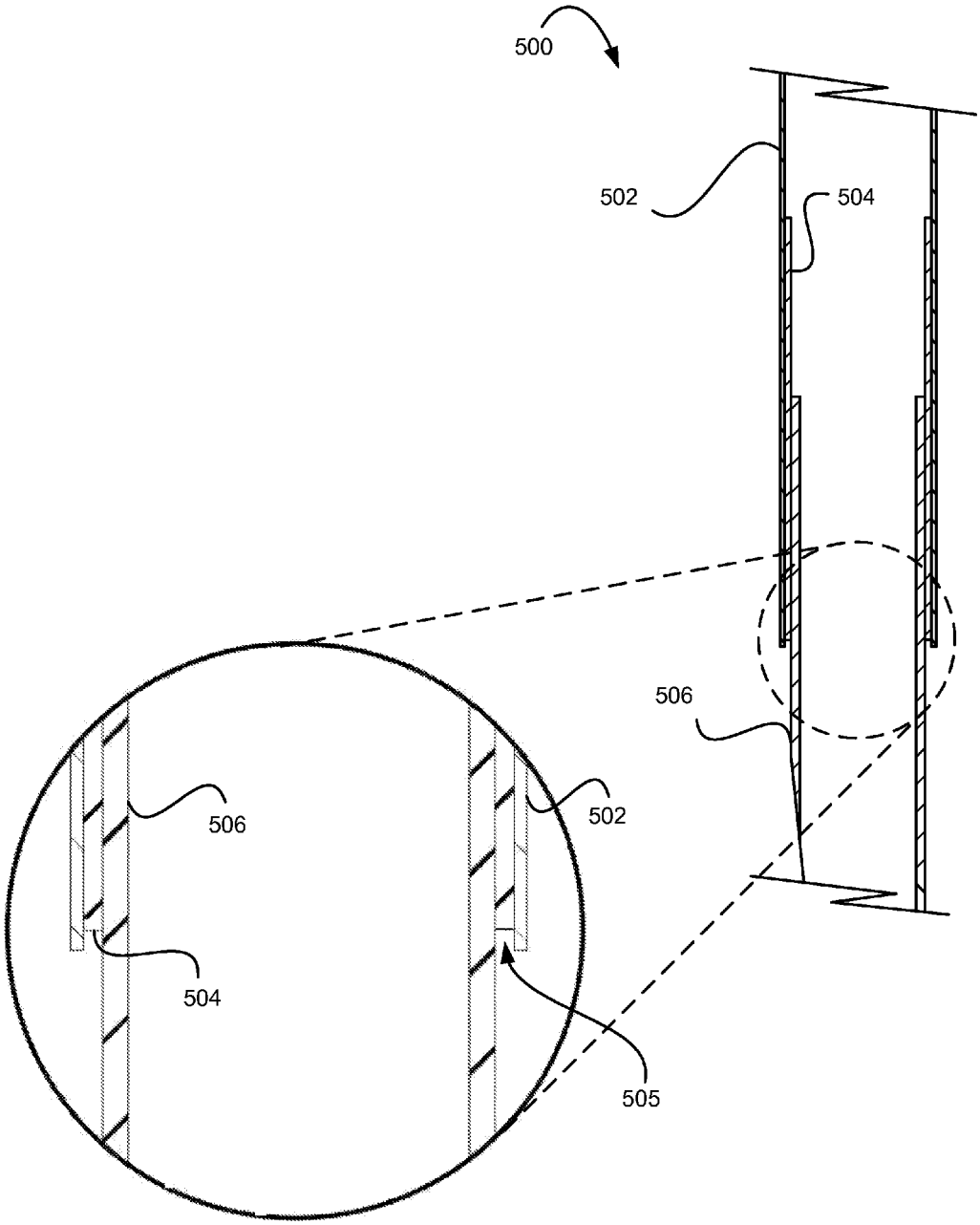
FIG. 5 is a schematic drawing illustrating component parts a section of a hiking stick, according to some embodiments of the present invention.

FIG. 5 is a schematic drawing illustrating component parts a section 500 of a hiking stick, according to some embodiments of the present invention. The section 500 may be substituted to any of the sections of FIGS. 1, 2, 3*a*, 3*b*, 4*a*, and 4*b*.

The section 500 includes an outer pipe 502, a sleeve 504 lining at least part of an inner surface of the outer pipe 502, and a hollow male joining piece 506, having a portion inside the outer pipe 502, and a portion outside the inner pipe 502.

The sleeve 504 lines separates the outer pipe 502 from the joining piece 506. The sleeve 504 is recessed within the outer pipe 502, leaving an empty space 505 between the outer pipe 502 and the joining piece 506. When the section 500 is connected to another section, the empty space 505 is designed for receiving a foreign material, such as dirt, which would otherwise collect at the distal edge of outer pipe 502 and prevent a full insertion of the section 500 into the second section. The above is shown in better detail in FIGS. 6*a* and 6*b*.

According to some embodiments of the present invention, the sleeve 504 lines the inner surface of the outer pipe 502 in all locations contiguous to the joining piece 506. Optionally, a proximal end of the sleeve 504 is farther away from the distal end of the joining piece 506 than a proximal end of the joining piece 506. Such a setup is arranged in order to protect the outer pipe from point loading when the hiking stick is under a large bending load, for example, when the hiker holding the hiking stick is about to fall. When the hiking stick is under a large bending load, the edge of the joining piece 506, which is located inside the outer pipe 502, exerts a heavy radial force on a small area of the outer pipe 502. This is known as point loading, and may cause the outer pipe 502 to break. Placing the sleeve 504 between the outer pipe 502 and the joining piece 506 may decrease the point loading on the outer pipe. In an exemplary embodiment of the present invention, the sleeve 504 is made of a material that is resistant to radial forces, such as aluminum.

According to some embodiments of the present invention, the outer pipe 502 is chosen to be made out of a light material, in order to decrease the weight of the walking stick of which the section 500 is a part of. In an exemplary embodiment of the present invention, the outer pipe is made of carbon fiber laminate.

Figure 6A:
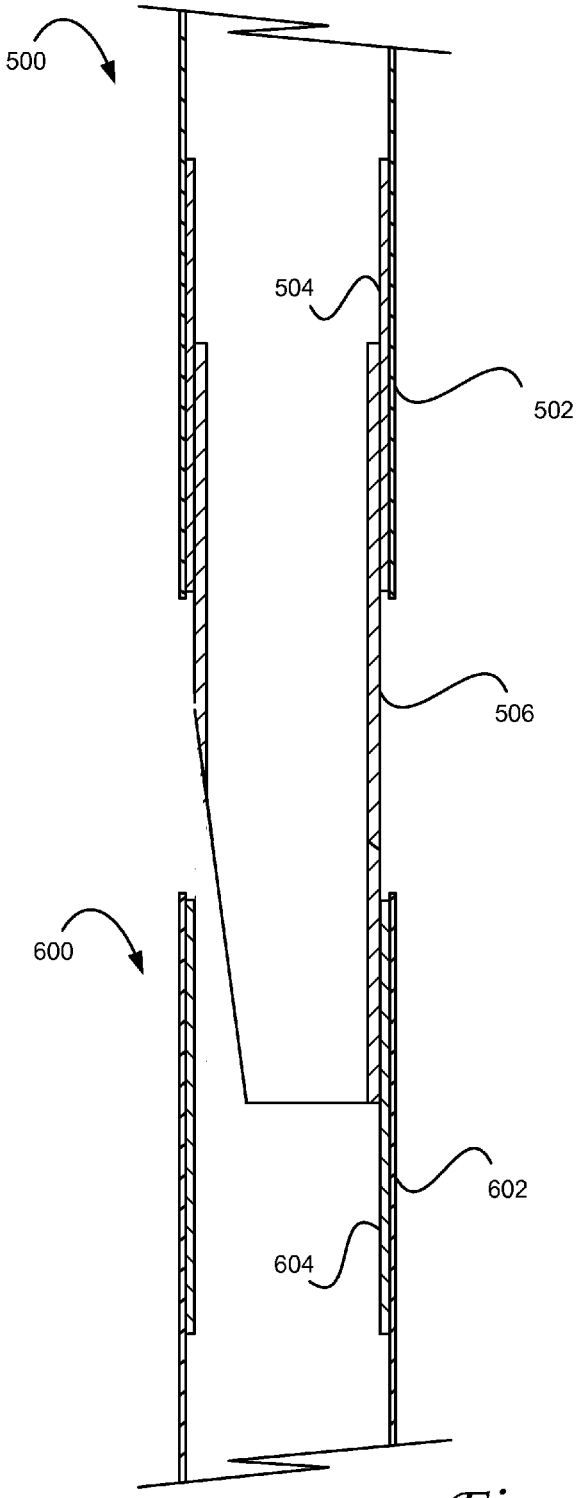
FIGS. 6*a* and 6*b* are schematic drawings illustrating the joining of two sections of a hiking stick, through the insertion of a male joining piece of the first section into a female end of the second section.
Figure 6B:
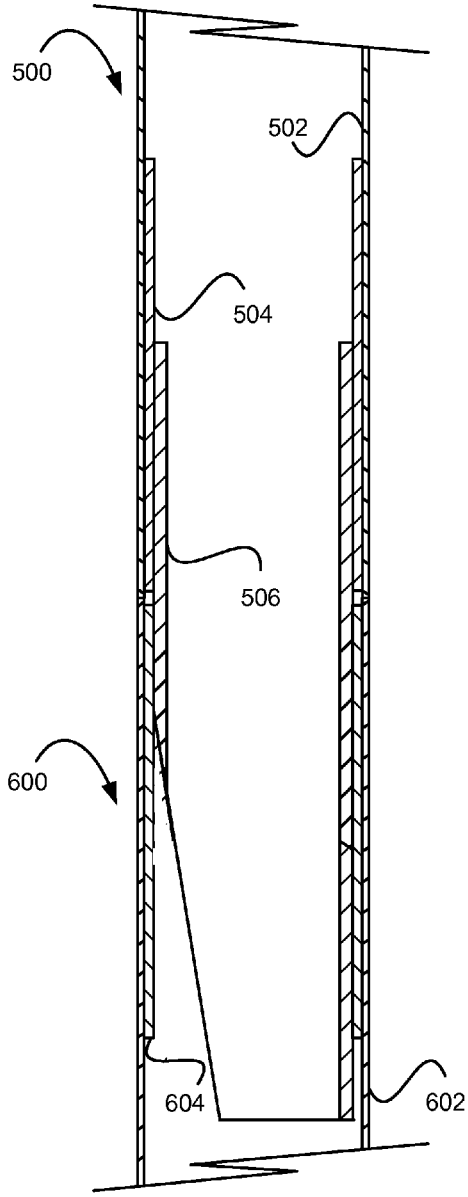

Optionally, the joining piece 506 is made of aluminum. According to some embodiments of the present invention, the joining piece 506 is designed to be inserted into a second section lined with a second aluminum sleeve (as shown in FIGS. 6*a* and 6*b*). If the joining piece 506 and the second aluminum sleeve are in contact for a length time in the presence of moisture, for a number of days (for example, 4, 5, or 10 days) aluminum galling may occur, and the section 500 may be difficult to disconnect from the second section. In an exemplary embodiment of the present invention, the sleeve 504 and the second sleeve are made of anodized aluminum, while the joining piece 506 is made of unanodized aluminum, in order to avoid aluminum galling. In another exemplary embodiment of the present invention, the sleeve 504 and the second sleeve are made of unanodized aluminum, while the joining piece 506 is made of anodized aluminum, in order to avoid aluminum galling.

The outer pipe 502 is attached to the sleeve 504, and the sleeve 504 is attached to the joining piece 506. According to an exemplary embodiment of the present invention, at least two of the above elements are made of different kinds of materials, and polyurethane glue is used for attaching the above element to each other. Polyurethane glue is flexible and may prevent the above elements from separating from each other in extreme heat and cold, when the different coefficients of expansion of the above materials may cause to the above elements to separate.

Optionally, epoxy may be used to bind above elements. In a variant, the outer pipe 502 is wrapped and cured around the sleeve 504. In such a case, the outer surface of the aluminum sleeve 504 is primed and prepared, so that epoxy used in the making of the carbon laminate sleeve 504 binds to the outer surface of the aluminum sleeve 504.

Optionally, the section 500 is tube member, which may be part of a piping structure.

FIGS. 6*a* and 6*b* are schematic drawings illustrating the joining of two sections of a hiking stick, through the insertion of a male joining piece of the first section into a female end of the second section. FIG. 6*a* shows a vertical cross section of two unjoined sections. FIG. 6*b* shows a vertical cross section of the two sections joined to each other.

The section 500 of FIG. 5 is inserted into a second section 600. The second section 600 is characterized by a second outer pipe 602, and a second sleeve 604, lining at least part of the inner surface of the second outer pipe 602. Optionally, the second sleeve 604 is recessed inside the second outer piece 602.

In FIG. 6*a,* the section 500 and the second section 600 are aligned so that the male joining piece 506 may be inserted into the second section 600.

In FIG. 6*b,* the section 500 has been connected to the section 600, through the full insertion of the male joining piece 506 into the second section 600. Part of an outer surface of the male joining piece 506 is brought in contact with the part of the inner surface of the second sleeve 604, providing the friction than keeps the sections 500 and 600 together. The outer pipe 502 of the section 500 is in contact with the second outer pipe 602 of the second section 600.

The sleeve 504 of the section 500 and the second sleeve 604 of the second section 600 do not touch. Rather an empty space is created between the sleeve 504 and the second sleeve 604. This empty space is designed for receiving a foreign material, such as dirt, which would otherwise deny contact between the outer pipe 502 and the second outer pipe 602. If the two outer pipes 502 and 602 are not in contact, the insertion of the male joining piece 506 into the second section 600 is not complete, therefore the friction that keeps the sections 500 and 600 together is decreased.

Optionally, the sections 500 and 600 are tube members joined together into a duct, for allowing the passage of a material, such as a liquid or gas.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof, the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A hiking stick, comprising:

a first section, comprising:

a first shaft; and a male joining piece attached to the shaft, and extending away from the shaft, the male joining piece having an uncut portion and a beveled portion, the bevel being formed by a plane cut at the end of the joining piece at an angle with a long the axis of the hiking stick; and a second section comprising a second shaft having a hollow end configured for receiving the male joining piece, such that an inner wall of the end of the second shaft has a radial cross section which is narrower than a radial cross section of the widest portion of the male joining piece;

wherein the male joining piece is configured for being inserted into the end of the second section, and for being radially compressed by the end of the second section, thereby providing friction between the second section and the male joining piece, and keeping the first and second sections together; and wherein the first section is repeatably insertable into and repeatably removable from the second section;

wherein the shaft of first section comprises:

a first outer pipe; and a first sleeve, lining at least part of an inner surface of the first outer pipe, and surrounding an insert of the male joining piece attached to the inner surface of the shaft of the first section; and the shaft of the second section comprising:

a second outer pipe; and a second sleeve, lining at least part of an inner surface of the second outer pipe;

wherein the first sleeve is recessed within the first outer pipe, thereby leaving an empty space between the first sleeve and the second sleeve when the first section and second section are connected, the empty space being configured for receiving a foreign material which would otherwise deny contact between an edge of the first outer pipe and an edge of the second outer pipe.

2. The hiking stick of claim 1:

wherein the first sleeve has a distal end, closest to the beveled potion of the joining piece, and a proximal end, farthest from the beveled potion of the joining piece;

wherein the male joining piece has a proximal end, located within the first section and farthest from the beveled potion of the joining piece; and wherein the proximal end of the first sleeve is disposed farther from the beveled potion of the joining piece than the proximal end of the joining piece, in order to reduce point loading on the outer pipe when the hiking stick is under a large bending load.

3. The hiking stick of claim 1, wherein the sleeves are made of aluminum and the outer pipes are made of carbon fiber laminate.

4. The hiking stick of claim 1, further comprising polyurethane glue for attaching at least one of the following pairs:

the first sleeve to the first outer pipe;

the first sleeve to the male joining piece; and the second sleeve to the second outer pipe.

5. The hiking stick of claim 1, wherein the second sleeve is made of anodized aluminum, and the male joining piece is made of unanodized aluminum.

6. The hiking stick of claim 1, wherein the angle formed by the plane cut and the long axis of the hiking stick is within a range between about 7 degrees and about 9 degrees.

7. The hiking stick of claim 1, wherein the angle formed by the plane cut and the long axis of the hiking stick is 8 degrees.

8. The hiking stick of claim 1, wherein the end of the joining piece is truncated, the truncation being formed by a cut of the beveled potion of the joining piece along a plane perpendicular to the long axis of the hiking stick; and wherein a radial cross section of the narrowest portion of the joining piece is smaller than the radial cross section of the hollow end of the second section.

9. The hiking stick of claim 1, further comprising a sliding handstrap wound around the hiking stick, and configured for being strapped around a wrist of a user;

wherein the handstrap is configured for being loosened, slid along the hiking stick, and tightened at a position chosen by a user.

10. The hiking stick of claim 9:

wherein the hiking stick is configured for being held by a user, such that the male joining piece is on a lower end of the first section, and the first section is above the second section;

wherein the handstrap is wound about the first section;

wherein a top edge of the first section is flared for preventing the handstrap from sliding off the top end the first section; and wherein a top edge of the second section is wider than the rest of the second section, for preventing the handstrap from falling off the bottom of the first section.

11. The hiking stick of claim 1, wherein the male joining piece comprises a knife edge;

wherein the knife edge is sheathed when the joining piece is inserted into the second section.

12. The hiking stick of claim 1, comprising:

a plurality of first and second sections, each section being connected to another via a male joining piece; and an end section, located at an end of the hiking stick;

wherein the end section is connected to one of the plurality of sections through the male joining piece of the one of the plurality of sections.

* * * * *